United States Patent [19]

Yamakawa et al.

[11] Patent Number: 4,804,281

[45] Date of Patent: Feb. 14, 1989

[54] PRINTING APPARATUS WITH A TYPE-WHEEL

[75] Inventors: Kiyoshi Yamakawa, Miyamachi; Satoshi Yoshimoto, Komaki, both of Japan

[73] Assignee: Brother Kogyo Kabushiki Kaisha, Aichi, Japan

[21] Appl. No.: 141,590

[22] Filed: Jan. 5, 1988

[30] Foreign Application Priority Data

Jan. 7, 1987 [JP] Japan ..... 62-2076

[51] Int. Cl.[4] ..... B41J 1/22

[52] U.S. Cl. ..... 400/144.2; 400/54

[58] Field of Search ..... 400/144.2, 322, 54, 400/279, 320; 101/93.19

[56] References Cited

U.S. PATENT DOCUMENTS

| | | | |
|---|---|---|---|
| 4,264,220 | 4/1981 | Okcuoglu | 400/144.2 |
| 4,293,233 | 10/1981 | Hoffman | 400/144.2 |
| 4,495,455 | 1/1985 | Oraki | 400/144.2 X |
| 4,605,324 | 8/1986 | Musso | 400/144.2 |
| 4,669,900 | 6/1987 | Miyake et al. | 400/322 |
| 4,746,235 | 5/1988 | Mueller et al. | 400/54 X |

FOREIGN PATENT DOCUMENTS 61-112954 5/1986 Japan .

*Primary Examiner*—David A. Wiecking
*Assistant Examiner*—James R. McDaniel
*Attorney, Agent, or Firm*—Barnes & Thornburg

[57] ABSTRACT

In the conventional printing apparatuses wherein a type-wheel and a carriage are driven respectively by stepping motors, after turning on power supply, a original position of the carriage is initialized by a sensor method, and a original position of the type-wheel is initialized by a step-out method. In this case, a sensor is required to be mounted within a very narrow range equivalent to several steps, and a stopper for restraining rotation of the type-wheel is required to be mounted within a very narrow range in the vicinity of a frame side wall.

Disclosed are a printing apparatus with a type-wheel and an initializing method of the printing apparatus wherein the carriage is restrained at the frame side wall part, the original position of the carriage is initialized by the step-out method, and after the carriage has been moved to a predetermined position near the printable range, then the reference positions of the type-wheel and the driving means thereof are agreed each other, and the carriage is moved to the vicinity of the frame side wall part, and the original position of the type-wheel is initialized by the step-out method.

9 Claims, 10 Drawing Sheets

PRINTING APPARATUS WITH A TYPE-WHEEL

BACKGROUND OF THE INVENTION

The present invention relates to a printing apparatus with a type-wheel, and specifically relates to the printing apparatus wherein both the original position of the type-wheel and the original position of a carriage are set by a step-out method. In this specification, above "step-out" means loss of synchronism.

In general, the printing apparatus with a type-wheel, for example, electronic typewriters are provided with at least a wheel drive motor consisting of a stepping motor for driving a type-wheel (hereinafter referred to as wheel) and a carriage drive motor consisting of a stepping motor for driving initializing setting the original position carriage, and initially setting the original position of the wheel and the original position of the carriage just after turning on power supply.

Then, the conventional printing apparatus are generally configurated in a manner that the original position of the wheel is set by the step-out method, and the original position of the carriage is set by the sensor method.

For example, as shown in the Japanese Utility Model Publication (non-examined) No. 61-112954 (FIG. 10), a sensor such as a photo interrupter outputting a carriage position detection signal is installed in the carriage, the carriage drive motor is set so as to be driven, for example, by two-phase excitation in the order of A.B phases, B.C phases, C.D phases, and D.A phases, and an operating piece operating the photo interrupter is mounted on the bottom part of a frame at nearly the center part between the left end of the frame and the position of left end (home position) of a printable range. Then, after turning on power supply, first ON or OFF of the carriage position detection signal is detected, and if it is ON, the carriage is moved rightward by 30 steps (M1 direction). Next the type-wheel is rotated clockwise (M2 direction) by two revolutions. Also, if it is OFF, the type-wheel is rotated by two revolutions in the M2 direction at that position without being moved rightward. That is , a pin installed at a place of the wheel strikes against a wheel engaging member in the carriage main unit by the first revolution, and by the second revolution, only the wheel flange attached to a motor shaft of the type-wheel drive motor is rotated while rotation of the type-wheel is restrained by the pin and the wheel engaging member, the pin energized by a spring is fitted into a notched part installed in the wheel flange, and thereby the reference position of the type-wheel is made to agree with the reference position of the type-wheel drive motor.

Then, the carriage is moved leftward step by step (M3 direction) to the position (position (1) in FIG. 10) where the carriage position detection signal is ON and the excitation phases becomes predetermined phases (A.B excitation phases in this case), and that position is set as the original position of the carriage.

Next, the carriage is moved rightward by four steps (M4 direction), and at the position (position (2) in FIG. 10) where the excitation phase becomes the above-mentioned predetermined phases (A.B excitation phases in this case), the carriage detection signal is confirmed to be OFF.

Furthermore, the carriage is moved leftward by 11 steps (M5 direction), and a detent is engaged with an engaging part of the wheel flange of the motor shaft by a stopper at the left end of the frame. Subsequently, the rotation of the wheel is restrained by the detent and the original position of the wheel is set by the step-out system. In this case, the wheel drive motor is rotated by one revolution in the M6 direction, and the wheel drive motor is set to the predetermined phase by a step-out operation. Then, to disengage the detent restraining the wheel, the wheel is rotated counterclockwise by 12 characters (M7 direction).

Then, the carriage is moved also to the set position of the left margin (M8 direction), and initializations of the wheel and the carriage are completed.

In addition, in the U.S. Pat. No. 4,264,220, a type-wheel original position setting apparatus is described which sets the original position of the wheel by a step-out system similar to the above-mentioned.

In the conventional electronic typewriters wherein, when power supply is turned on, the original position of the wheel is set by the step-out system, and the original position of the carriage is set by the sensor system, the original position of the carriage is set at the position (1) FIG. 10, and therefore the position of mounting of the operating piece has to be set precisely so that the carriage position detection signal is ON at the position (1) of predetermined excitation phase and the carriage position detection signal is OFF at the position (2) of the predetermined excitation phase, that is, so that the carriage position detection signal is changed-over to ON or OFF within an allowable range of four steps equivalent to symbol L in the drawing.

In the above-mentioned case, the four-step rotation of the carriage drive motor is equivalent to a distance of about 0.8 mm of movement of the carriage. This means that the position of mounting of the operating piece has to be set within a very narrow allowable range of about 0.8 mm, and therefore mounting and positional adjustment of the operating piece are very difficult works.

For that reason, the printing apparatus has a problem that even a skilled workman necessitates much labor and time for mounting and positional adjustment of the operating piece in manufacturing and overhauling it. Then, the printing apparatus has another problem that it cannot be overhauled without a skilled workman of this kind.

Furthermore, in the case where the position of mounting of the operating piece is located close to the position (1), the operation of M2 is sometimes executed between the position (1) and the position (2), and therefore the position of mounting of the stopper for operating the detent cannot be lapped over a switch mounting allowable range as shown L in FIG. 10, and is required to be set at the position a predetermined distance removed left from the allowable range, and therefore the allowable range of the position of mounting of the stopper becomes narrow, and much time is required for adjusting the position of mounting of the stopper, and accordingly this work is also a difficult work.

SUMMARY OF THE INVENTION

The object of the present invention is to provide a printing apparatus with a type-wheel and an initializing method of the above-mentioned printing apparatus wherein an allowable range of the mounting position for mounting of a carriage position detecting switch used for setting the original position of a carriage can be expanded to a great extent, and an allowable range of the position of mounting of a stopper restraining rotation of a wheel when setting the original position of the wheel can be expanded to a great extent.

The present first invention relates to a printing apparatus with a type-wheel having a frame, a carriage for mounting a type-wheel rotatably, a first stepping motor for driving the carriage, wheel driving means which is mounted on the carriage and has a second stepping motor for driving the type-wheel, engaging means for making a reference position of the type-wheel agree with a reference position of the wheel driving means, and wheel original position setting means which, after making the both reference positions agree with each other through the engaging means, sets the original positions of the type-wheel and the second stepping motor by a step-out method.

The above-mentioned printing apparatus is characterized by comprising: a carriage detecting switch installed in a first allowable range which overruns to a side wall part side of the frame beyond a printable range within a movable range of the carriage and has a length equivalent to a plurality of cycles of excitation phase of the first stepping motor; carriage original position setting means which, according to an output of the carriage detecting switch, drives the first stepping motor by a predetermined number of steps so that the carriage moves further toward the side wall part from the state that the carriage is positioned at the side wall part side beyond the carriage detecting switch, and puts the first stepping motor in the step-out state by making the carriage strike against the side wall part, and thereby sets the original positions of the carriage and the first stepping motor; rotation defining means for restraining rotation of the type-wheel or the wheel driving means to put the second stepping motor in the step-out state by the wheel original position setting means; and a stopper installed in a second allowable range overlapping partly with the first allowable range to operate the rotation defining means.

The above-mentioned wheel original position setting means moves the carriage from the position where the first stepping motor is put in the step-out state to a predetermined position in the vicinity of the printable range outside the first allowable range, thereafter rotates the wheel driving means, and makes the both reference positions of the type-wheel and the wheel driving means agree with each other by the engaging means, and further moves the carriage to the position where rotation of the type-wheel or the wheel driving means is restrained by the stopper through the rotation defining means.

The present second invention relates to an initializing methods of a printing apparatus with a type-wheel having a frame, a carriage for mounting the type-wheel rotatably, a first stepping motor for driving the carriage, wheel driving means which is mounted on the carriage and has a second stepping motor for driving the type-wheel, engaging means for making a reference position of the type-wheel agree with a reference position of the wheel driving means, rotation restraining means for restraining rotation of the type-wheel at the position in the vicinity of the side wall part of the frame, and a carriage detecting switch for detecting that the carriage has moved to the side wall part side beyond the printable range within the movable range thereof.

The above-mentioned initializing method is characterizing by comprising: a step for moving the carriage to the side wall part side and for operating the carriage detecting switch; a step for further driving the first stepping motor by a predetermined number of steps to move the carriage until it strikes against the side wall part after operation of the carriage detecting switch and for driving the first stepping motor in predetermined excitation phases by putting it in the step-out state; a step for moving the carriage to a predetermined position in the vicinity of the printable range; a step for making the both reference positions of the type-wheel and the wheel driving means agree with each other at the predetermined position by the engaging means; a step for moving the carriage toward the side wall part and for restraining rotation of the type-wheel or the wheel driving means by the rotation restraining means; and a step for putting the second stepping motor in the step-out state and for exciting it in predetermined phases.

In a printing apparatus in accordance with the present first invention, based on an output of the carriage detecting switch installed in the first allowable range, by the carriage original position setting means, the first stepping motor is driven by a predetermined number of steps so that the carriage moves toward the side wall part of the frame beyond the carriage detecting switch and is put in the step-out state by making the carriage strike against the side wall part, and thereby the original position of the carriage is set.

Then, by the wheel original position setting means, first the carriage is moved from the position where the first stepping motor stepped out to a predetermined position in the vicinity of the printable range outside the first allowable range, the wheel driving means is rotated, and thereby the both reference positions of the type-wheel and the wheel driving means are made to agree with each other through the engaging means, and the carriage is further moved to the position where rotation of the type-wheel or the wheel driving means is restrained by the stopper installed in the second allowable range through the rotation defining means, and at this position the stepping motor is put in the step-out state, and thereby the original position of the wheel is set.

As described above, in accordance with the printing apparatus according to the present first invention, the original positions of the carriage and the first stepping motor for driving it are set by the step-out method and therefore the first allowable range wherein the carriage detecting switch is installed can be expanded to a length equivalent to a plurality of cycles of excitation phase of the first stepping motor. Also, after the original positions of the carriage and the first stepping motor have been set, the carriage is moved to a predetermined position in the vicinity of the printable range outside the first allowable range, and the both reference positions of the type-wheel and the wheel driving means are made to agree with each other at that position through the engaging means, and therefore the second allowable range wherein the stopper is installed can be set longer by partly overlapping with the first allowable range.

Thus, the first allowable range can be set to a length equivalent to a plurality of cycles of excitation phase of the first stepping motor, and therefore positional adjustment in mounting the carriage detecting switch becomes very simple, or almost unnecessary. Furthermore, since the second allowable range can be set longer, positional adjustment in mounting the stopper becomes very simple, or almost unnecessary. Accordingly, even those not skilled in the art can simply perform mounting and overhaul of the carriage detecting switch and the stopper in a short time.

In accordance with the initializing method of the printing apparatus with a type-wheel of the present second invention, the same effects and advantages as the abovedescribed are obtainable.

BRIEF DESCRIPTION OF THE DRAWINGS

FIG. 1 is a schematic plan view of a typewriter,

FIG. 2 is a vertical cross-sectional left side view of the typewriter in FIG. 1, FIG. 3 is a rear view of a carriage, FIG. 4 and FIG. 5 are vertical cross-sectional left side views of a type wheel and a wheel flange, FIG. 6 is a breakdown perspective view of a stopper, an operating member and a rotary plate, FIG. 7 is a block diagram of a control system of the typewriter, FIG. 8 is an explanatory view of operation when the original positions of the carriage and the type-wheel are set, FIG. 9 is a flow chart of a control routine of setting the original positions of the carriage and the type-wheel.

DESCRIPTION OF THE PREFERRED EMBODIMENT

Hereinafter, description is made on a preferred embodiment in accordance with the present invention with reference to the drawings.

This embodiment is of the case where the present invention is applied to an electronic typewriter. In addition, to make the description clear, the printing direction is referred to as the right direction.

Figure 1:
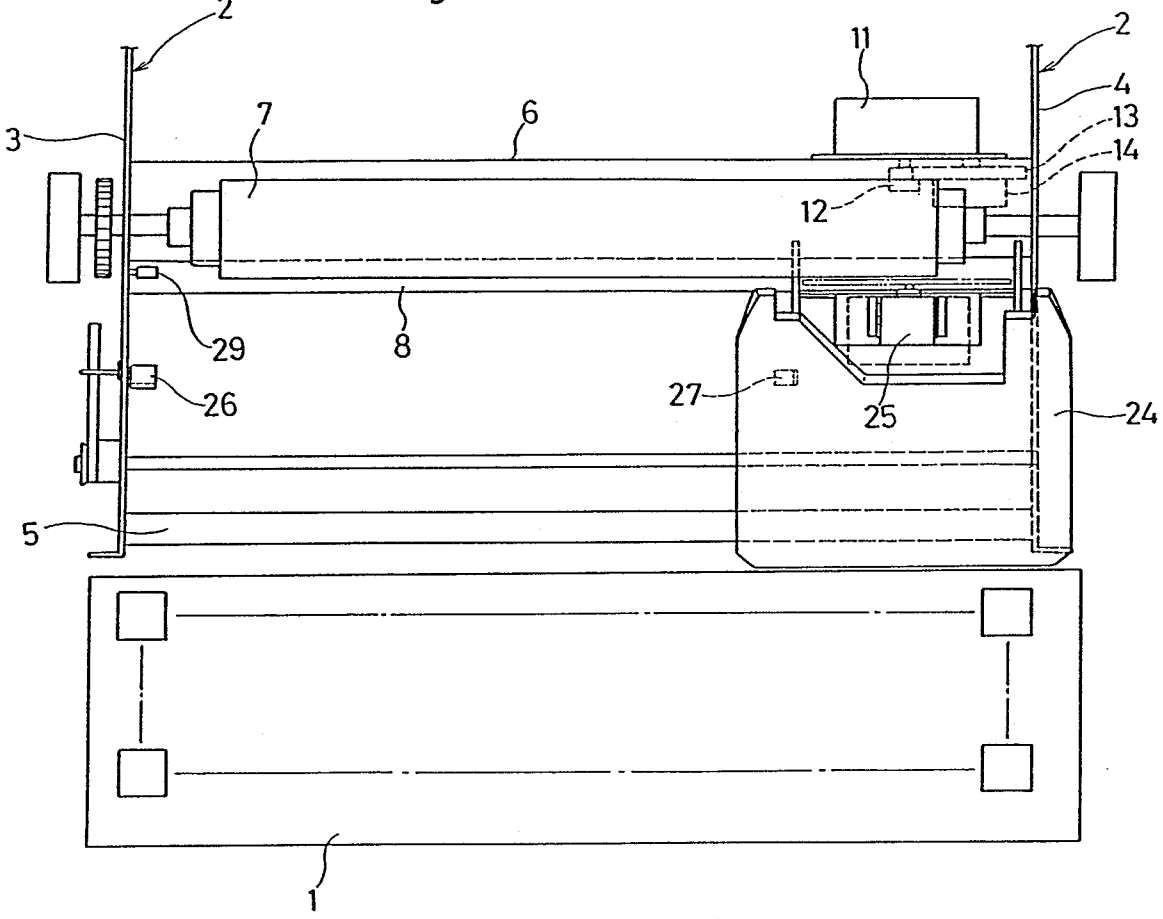
FIG. 1 through FIG. 9 relate to an embodiment in accordance with the present invention.
Figure 2:
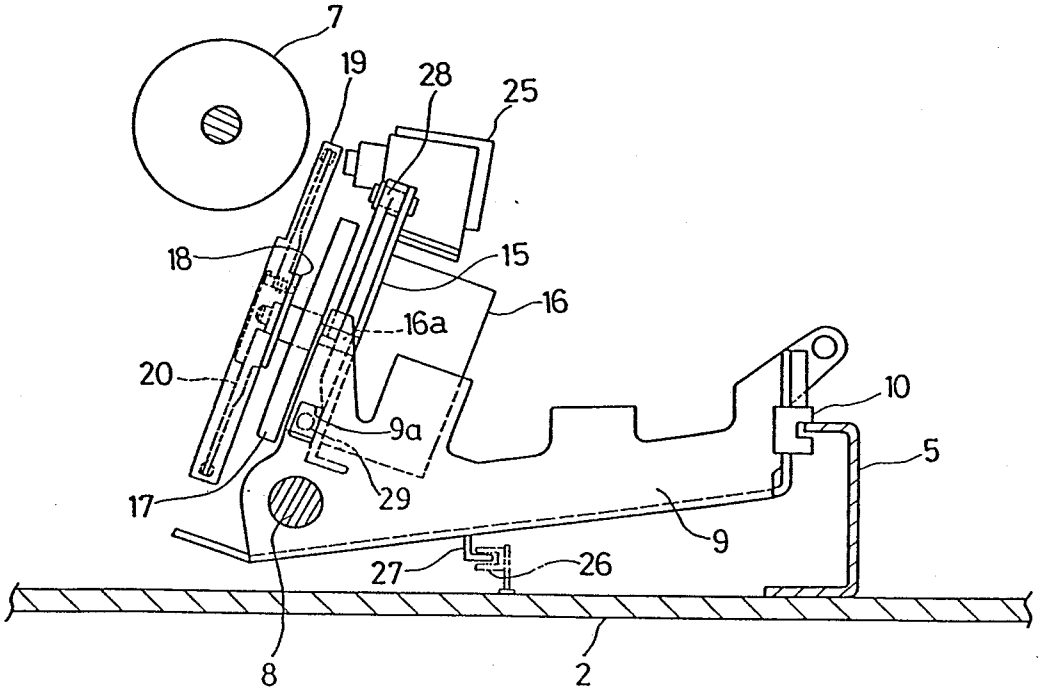

As shown in FIG. 1, a keyboard 1 is disposed at the front part of a typewriter, and a pair of front and rear connecting frames 5 and 6 nearly U-shaped in section are installed fixedly between both right and left side wall parts 3 and 4 of a frame 2 behind the keyboard 1. A platen 7 is supported rotatably between the both side walls 3 and 4 above the rear connecting frame 6. Also, a guide shaft 8 extending in parallel to the platen 7 is installed in the frame 2 and a carriage 9 formed with a bent metal plate is supported movably along the platen 7 at the rear part thereof. Furthermore, a guide piece 10 installed in the front part of the carriage 9 is engaged movably with the top part of the connecting frame 5.

On the right side of the rear surface of the connecting frame 6, a carriage drive motor 11 consisting of a stepping motor is mounted, and a drive pulley 14 is disposed which is driven rotatively through a drive gear 12 and a driven gear 13 with rotation of the motor 11. A wire rope (not shown) is set around this drive pulley 14 and a driven pulley (not illustrated) supported rotatably by the left side wall part 3 of the frame 2, and part of the wire rope is fixed to the carriage 9. Then, with rotation of the drive pulley 14, the carriage 9 is moved along the platen 7 through the driven pulley and the wire rope. In addition, the carriage drive motor 11 is constituted with a stepping motor having four stator excitation phases consisting of an A phase through a D phase.

Figure 3:
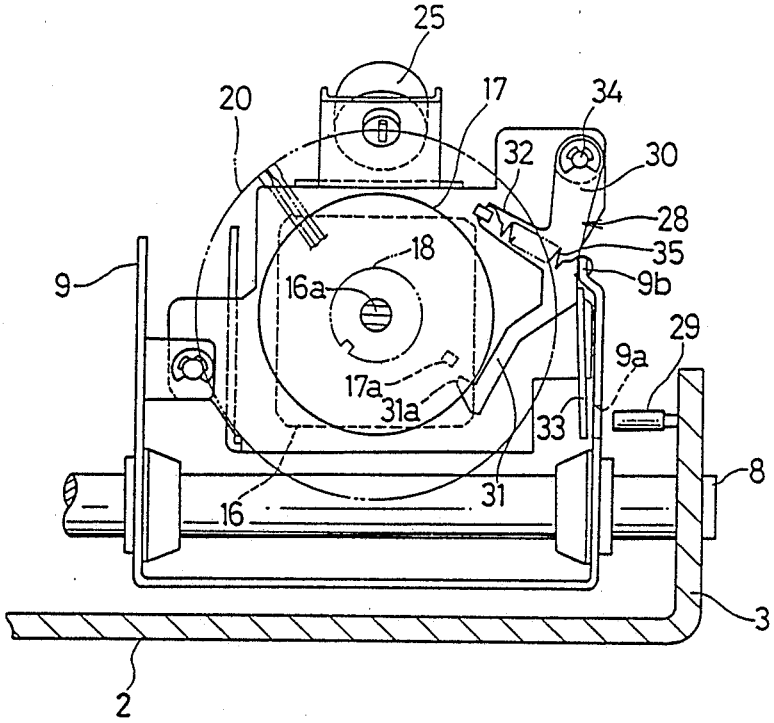

As shown in FIG. 3, a type-wheel drive motor 16 consisting of a stepping motor is fixed to a bracket 15 fixed in the carriage 9, and a rotary plate 17 on the rear side surface of the bracket 15 is attached fixedly to a motor shaft 16*a* extending with penetrating through the bracket 15. A protrusion 17*a* is formed integrally at a place on the front surface of this rotary plate 17. Furthermore, on the rear surface of the rotary plate 17, a wheel flange 18 having a notched part 18*a* formed on a part of the circumference thereof is attached to the motor shaft 16*a*. That is, the rotary plate 17 and the wheel flange 18 are rotated by rotation of the type-wheel drive motor 16.

Figure 4:
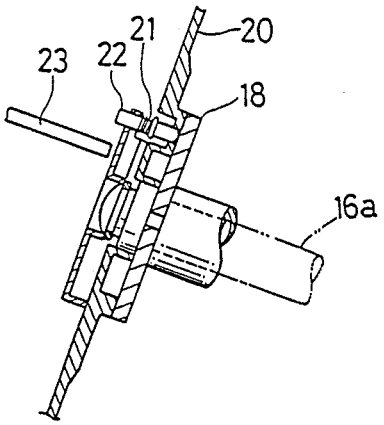

Then, a type-wheel 20 housed in a cassette holder 19 in contact with the rear surface of the wheel flange 18 is attached detachably. A pin 22 energized forward by a spring 21 is disposed at a place in the vicinity of the outer periphery of the thick part of the type-wheel 20 where the wheel flange 18 contacts, and as shown in FIG. 4, this pin 22 is pushed by the wheel flange 18 and projects backward.

Figure 5:
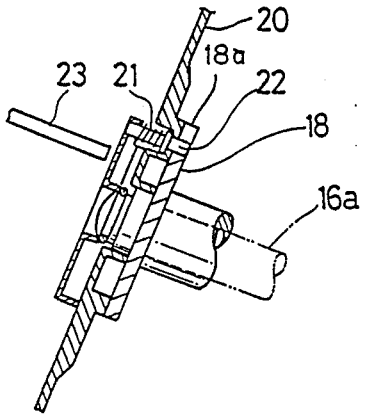

In this condition, when the type-wheel drive motor 16 is rotated, the rear end part of this pin 22 is caught by a defining member 23 installed right behind the type-wheel 20 in the carriage 9, and rotation of the type-wheel 20 is restrained, and as shown in FIG. 5, only the wheel flange 18 is rotated, and thereby the pin 22 fits into the notched part 18*a* of the wheel flange 18, and thus the type-wheel 20 is rotated synchronously together with the wheel flange 18. Accordingly, the reference position of the type-wheel 20 agrees with the reference position of the type-wheel drive motor 16.

A ribbon cassette 24 is loaded on the carriage 9, and a hammer solenoid 25 for hammering types is mounted on the type-wheel drive motor 16. Also, an operating piece 27 for operating (ON state) a carriage detecting switch 26 is attached to the lower part of the carriage 9. Furthermore, the carriage detecting switch 26 and a stopper 29 for moving rotatively an operating member 28 to the restraining position are disposed in the vicinity of the left side wall part 3 of the frame 2.

Figure 6:
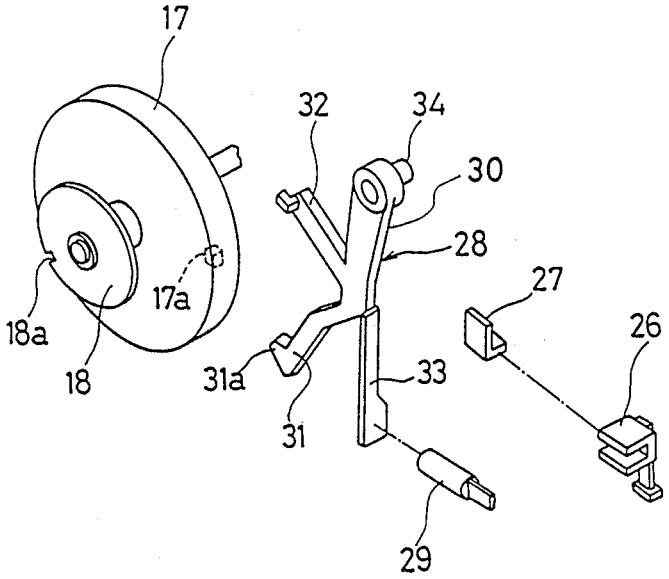

As shown in FIG. 3 and FIG. 6, the plastic operating member 28 formed in a four-arm shape is supported rotatably by a pin 34 at the free end of a first arm 30 thereof, and an engaging part 31*a* engageable disengageably with the protrusion 17*a* is formed at the free end of a second arm 31. A spring 35 is set between the free end of a third arm 32 of this operating member 28 and a spring hooking piece 9*b* installed on the carriage 9 in a protruded fashion. Then, in FIG. 3, the operation member 28 is energized to rotate counterclockwise by the spring 35, and the side edge of the operating member 28 is engaged with the spring hooking piece 9*b* all the time, being disposed at the non-restraining position located outside the locus of rotation of the protrusion 17*a*. In addition, a fourth arm 33 is formed in a thin plate shape, extending downward from the intermediate part of the operating member 28. A hole 9*a* is formed in the carriage 9 so as to face the free end of this fourth arm 33.

When the carriage 9 moves to the vicinity of the left side wall part 3 of the frame 2, the free end of the fourth arm 33 is pushed right by the stopper 29 penetrating through the hole 9*a*, and the operating member 28 is rotated clockwise in FIG. 3, and thereby the operating member 28 is rotated to the position where the engaging part 31*a* engages with the protrusion 17*a*, that is, the restraining position.

Figure 7:
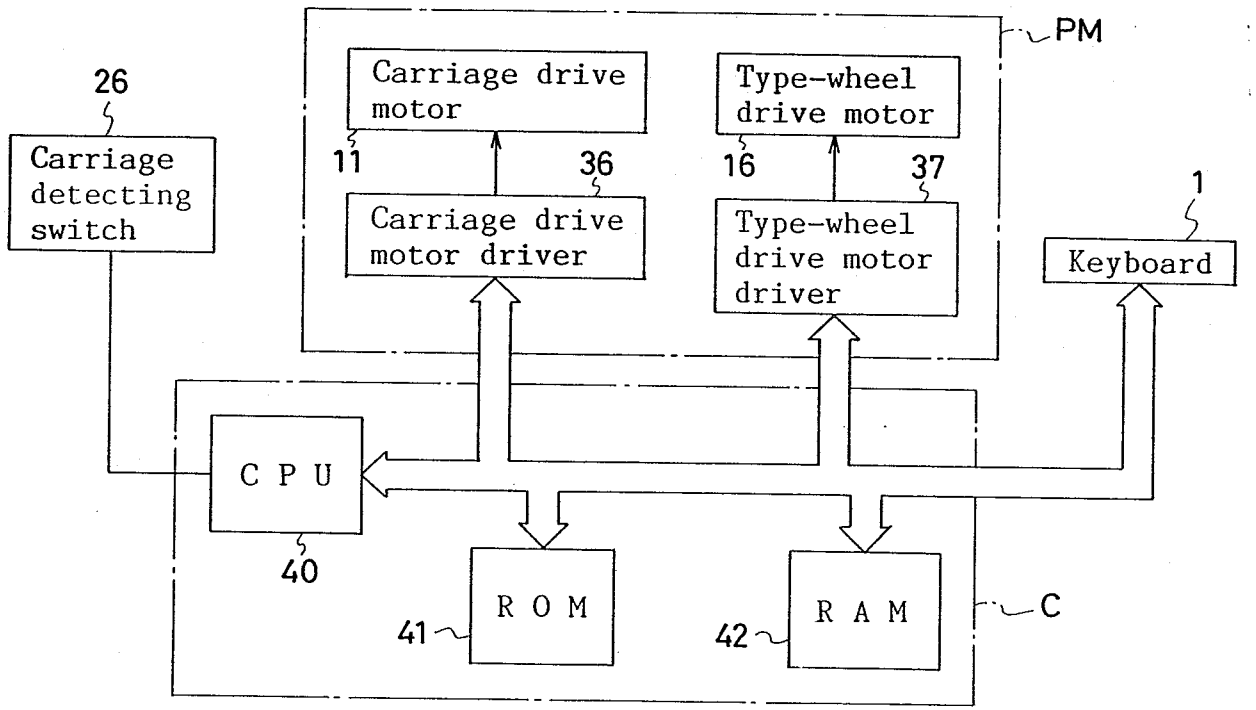

Next, description is made on the whole configuration of a control system of the electronic typewriter with reference to a block diagram in FIG. 7.

Basically, the typewriter is constituted with the keyboard 1, a printing mechanism PM, a controlling apparatus C and the like, and the keyboard 1 and the printing mechanism PM are connected to a CPU (central processing unit) 40 of the controlling apparatus C through a data bus and the like.

The printing mechanism PM comprises at least the carriage drive motor 11 and a driver 36 thereof, the type-wheel drive motor 16 and a driver 37 thereof and the like. Also, the controlling apparatus C is constituted with the CPU 40, a ROM (read only memory) 41 and a RAM (random access memory) 42 connected to the CPU 40 through a data bus or the like.

In a program memory of the ROM 41, a control program controlling the printing mechanism PM correspondingly to code data entered from each character key and each function key on the key-board 1, a control program controlling setting of the original positions of the carriage 9 and the type-wheel 20 as described later are stored. Then, the RAM 42 is provided with, in addition to various memories which temporarily store the results of arithmetic processing made by the CPU 40 when controlling the printing mechanism PM, a counter I for counting the number of times of excitation of the predetermined C.D phases when driving the carriage drive motor 11.

Furthermore, a detection signal from the carriage detecting switch 26 is outputted to an input port of the CPU 40 through an interface.

Figure 8:
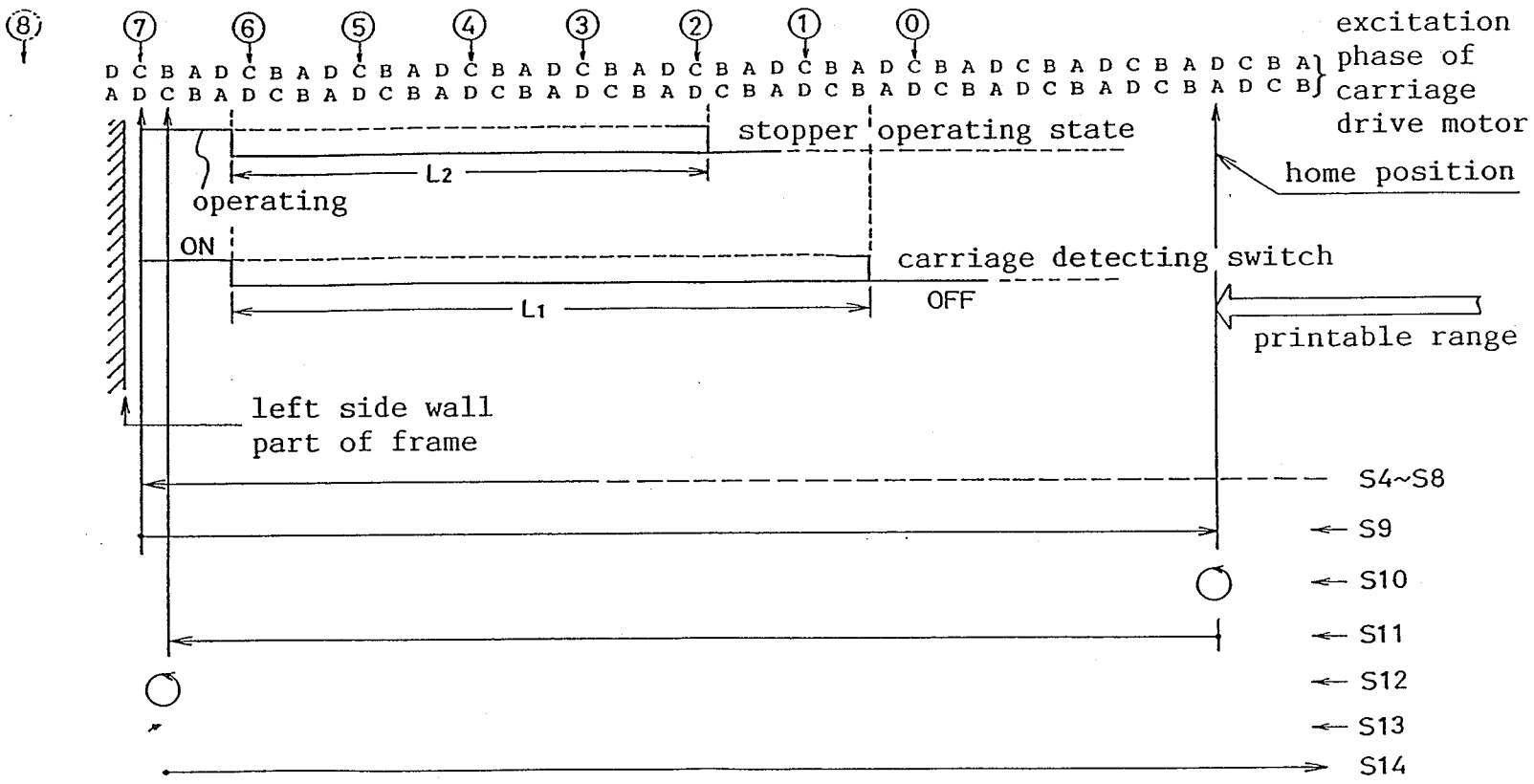
Figure 9:
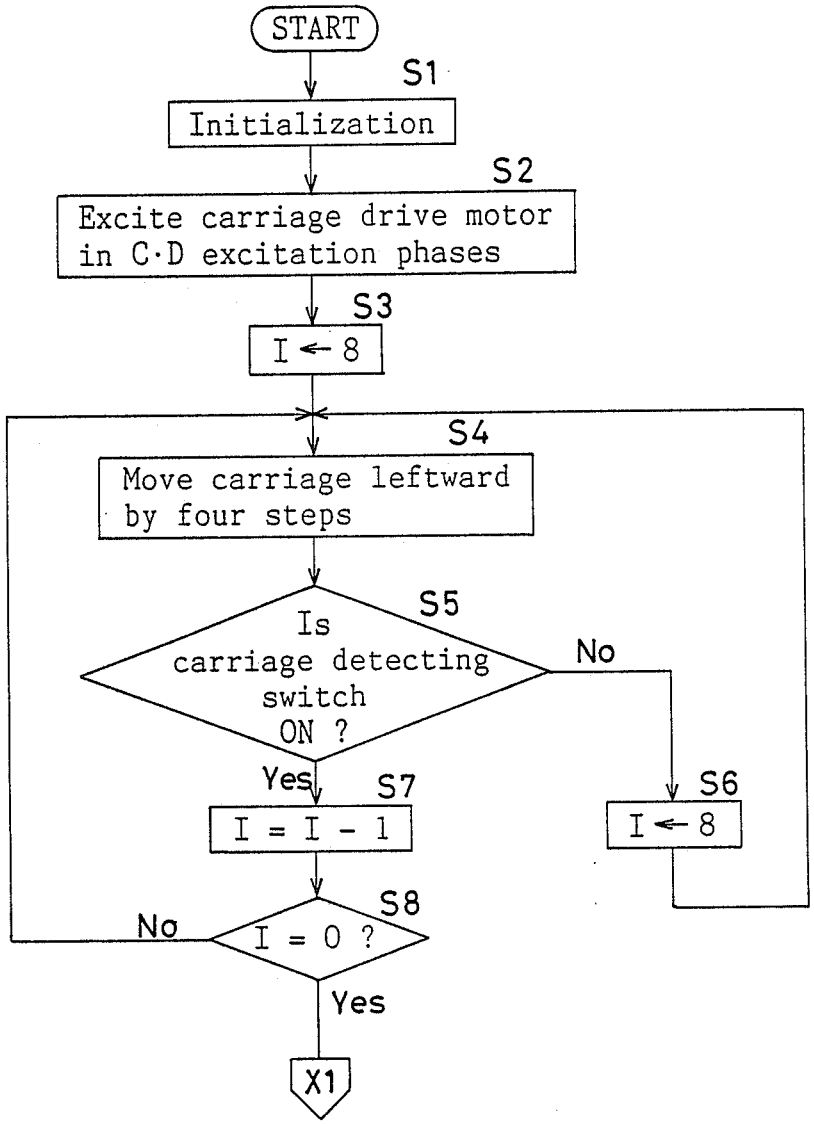
Figure 9:
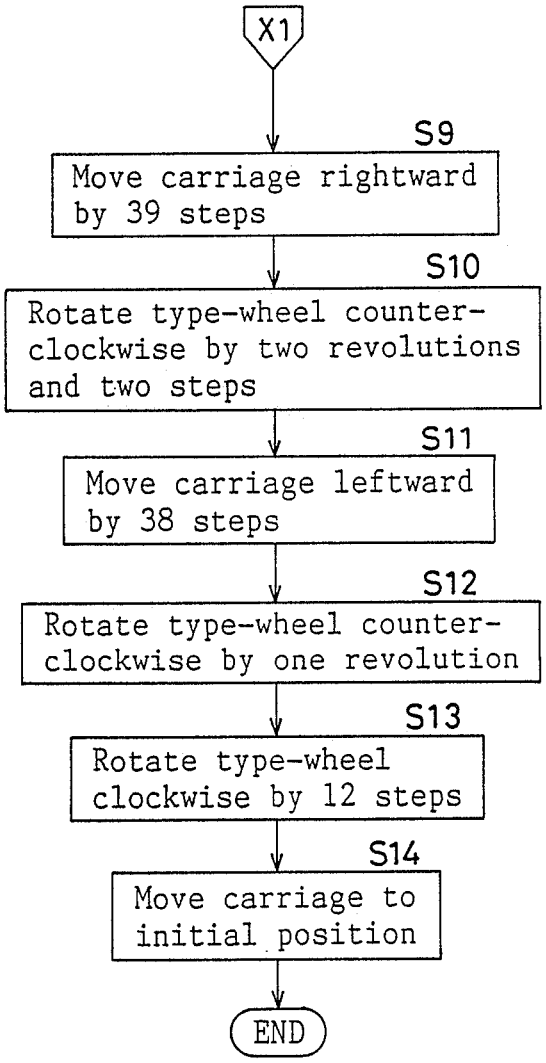
Figure 10:
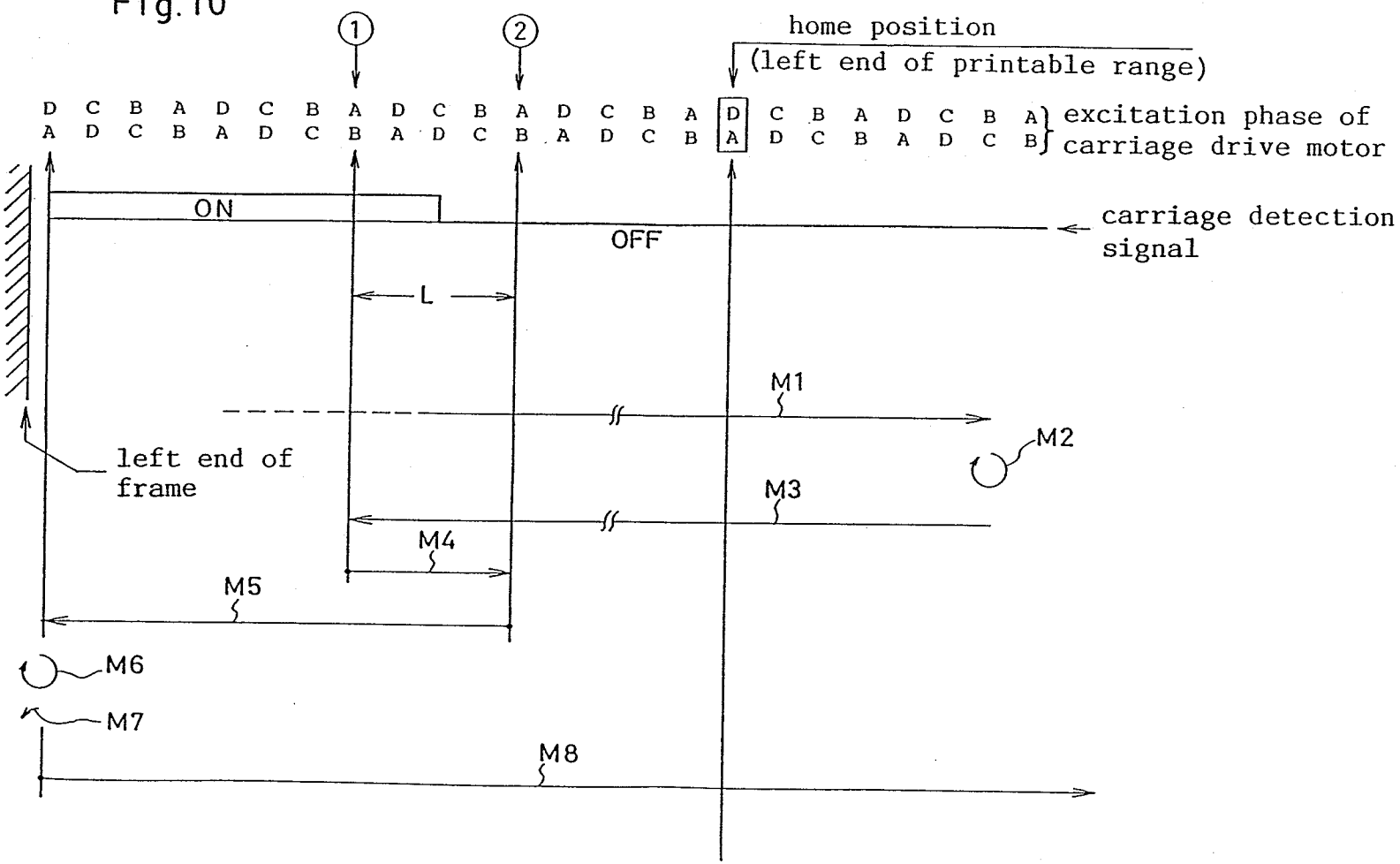
FIG. 10 is a view relating to the prior art which is equivalent to FIG. 8.

Next, description is made on the control of setting the original positions of the carriage 9 and the type-wheel 20 which are performed in the controlling apparatus C of the electronic typewriter with reference to a flow chart in FIG. 9 in reference to FIG. 8.

In addition, in this control, the carriage drive motor 11 is driven by two-phase excitation in sequence in the order of A.B phase, B.C phases, C.D phases and D.A phases when moving the carriage leftward, and is driven sequentially in the order reverse to the above-mentioned order when moving the carriage 9 rightward, and the controlling apparatus C detects the C.D phases excitation.

When the power switch of the electronic typewriter is turned on, this control is started, and processing moves to STEP S1 (hereinafter, expressed simply by S1, and the same is true of the other STEPs), and initialization such as resetting of the counter I is executed, and processing proceeds to S2. In S2, the carriage drive motor 11 is excited in the C.D phases. In the following S3, "8" is set in the counter I.

The following S4–S8 are steps for setting the original position of the carriage 9 and for setting the set excitation phases (C.D phases) of the carriage drive motor 11 at this position, and in S4, the carriage 9 is moved leftward by four steps (direction toward left side wall part 3), to the position of the next C.D phases excitation. At this time, the CPU 40 outputs a control signal to the carriage drive motor driver 36.

In the next S5, judgement is made on whether the carriage detecting switch 26 is ON or not based on a detection signal from the carriage detection switch 26, and if NO, processing proceeds to S6 where the counter I is set again to "8", and returns to S4. Then, S4–S6 are repeated, thereby the carriage 9 is moved leftward by four steps every time, and if the result of judgment in S5 is YES, processing moves to S7, where 1 is substracted 1 from the counter I, and moves to S8.

In S8, judgment is made on whether or not the count value of the counter I is "0", and if not "0", processing returns to S4. Then S4–S5 and S7–S8 are repeated, and when the count value of the counter I becomes "0", processing moves to S9.

At this time, the carriage drive motor 11 is controlled so as to rotate slowly, that is, the excitation time for each phase is set longer, overshoot of the rotor in the step-out state is reduced and the rotor is stopped in a predetermined phase, thereby detection of the original position of the carriage can be performed accurately.

Here, as shown in FIG. 8, an allowable range $L_1$ for mounting the carriage detecting switch 26 can be set wide as follows. Since the step-out method is adopted to set the original position of the carriage 9 and the set excitation phases of the carriage drive motor 11, the position where the carriage detecting switch 26 is turned to ON has only to be within a range from the position overrunning the printable range to the left side wall part 3 of the frame 2, and also when this range is set to 4–5 mm, the position of mounting of the carriage detecting switch 26 can be nearly free from adjustment, and therefore 23 steps (about 4.9 mm) is provided as the allowable range $L_1$ at the position as shown in FIG. 8, and the set value of the counter I is set to "8", and thereby even if the carriage detecting switch 26 is turned to ON at the rightmost position of the allowable range $L_1$, the count value of the counter I becomes "1" at the position (7) of the C.D phases excitation and the carriage drive motor 11 is put in the step-out state by four steps.

In addition, numerals (1)–(8) designate the positions of the C.D phases excitation when the count value of the counter I is subtracted in sequence.

In S9, the carriage 9 is moved rightward by 39 steps, being positioned out of the allowable range $L_1$. In the next S10, the type-wheel 20 is rotated counterclockwise by two revolutions and two characters.

At this time, as shown in FIG. 4, in the state that the pin 22 is moved rearward by the wheel flange 18, when the type-wheel drive motor 16 rotates by one revolution, the type-wheel 20 is rotated, and the rear end part of the pin 22 is caught by the defining member 23, and when the type-wheel drive motor 16 further rotates by one revolution and two characters, as shown in FIG. 5, the front end part of the pin 22 fits into the notched part **18*a*, and the reference position of the type-wheel 20 and the reference position of the wheel flange 18, that is, the reference position of the type-wheel drive motor 16** agree with each other.

In S11, the carriage 9 is moved leftward by 38 steps. Then, as shown in FIG. 3, the stopper 29 pushes the free end of the fourth arm 33 of the operating member 28, and thereby the operating member 28 is positioned at the restraining position, and as shown in FIG. 8, an allowable range $L_2$ wherein the stopper 29 is mounted so that the operating member 28 is positioned at the restraining position is provided so as to be equivalent to 17 steps (about 3.6 mm) in view of manufacturing errors of the operating member 28, the stopper 29 and the frame 2 and mounting errors when mounting them and additional margin, and is set in the range partly overlapped with the allowable range $L_1$. In the next S12, the type-wheel 20 is rotated counterclockwise by one revolution and two steps (two characters). At this moment, the operating member 28 has already moved to the restraining position, and therefore the engaging part **31*a* engages with the protrusion 17*a*, the rotation of the motor shaft 16a is restrained, the type-wheel drive motor 16 is put in the step-out state, the original position of type wheel drive motor 16 (set excitation phases) agrees with the original position of the type-wheel 20**, and a defined relation between the both original positions is set.

Then, in S13, the type-wheel 20 is rotated clockwise by 12 steps. Thus, the protrusion 17a is parted from the engaging part 31a, and the engagement thereof is released. In the next S14, the carriage 9 is moved to a initial position, that is, the position of the set left margin, and this control is completed.

In addition, attending on movement of the carriage 9 to the left margin position, the operating member 28 returns to the non-restraining position.

As described above, the original positions of the carriage 9 and the carriage drive motor 11 are set by the step-out method, and therefore the allowable range $L_1$ wherein the carriage detecting switch 26 is installed can be expanded to a wide range equivalent to 17 steps.

After setting of the original positions of the carriage 9 and the carriage drive motor 11, the carriage 9 is moved rightward by 39 steps, and at that position, the reference positions of the type-wheel 20 and the type-wheel motor 16 are made to agree with each other, and subsequently the carriage 9 is moved leftward by 38 steps, and the type-wheel motor 16 is put in the step-out state by the operating member 28, and thereby the original position of the type-wheel 20 and the set excitation phases of the type-wheel motor 16 are made to agree with each other, and therefore it is possible to expand the allowable range $L_2$ wherein the stopper 29 is installed and set it so as to partly overlap with the allowable range $L_1$.

That is, since the allowable range $L_1$ can be expanded, positional adjustment in mounting the carriage detecting switch 26 becomes very simple or almost unnecessary. Furthermore, the allowable range $L_2$ can be expanded, positional adjustment in mounting the stopper 29 becomes very simple or almost unnecessary.

Accordingly those not skilled in the art can simply perform mounting and overhaul of the carriage detecting switch 26 in a short time.

Also, in the above-mentioned embodiment, the C.D phases excitation of the carriage drive motor 11 is set and detected, but the A.B phases, the B.C phases or the D.A phases may be set and detected.

In addition, in the above-mentioned embodiment, the carriage detecting switch 26 is installed on the left side wall part 3 of the frame 2, and the operating piece 27 is installed in the carriage 9, but the carriage detecting switch 26 may be installed in the carriage 9 and the operating piece 27 may be installed on the left side wall part 3.

What is claimed is:

1. In a printing apparatus with a type-wheel having a frame, a carriage movable within a movement range including a printable range, a first stepping motor for driving said carriage, rotary means rotatably mounted on said carriage for mounting said type-wheel rotatably, a second stepping motor for driving said rotary means, and connecting means for operatively connecting said type-wheel with said rotary means when a reference position of said type-wheel aligns with a reference position of said rotary means, said printing apparatus comprising:

carriage detecting means installed in a first allowable range which is within said movement range, set between a side wall of said frame and said printable range;

carriage original position setting means for controlling the driving of said first stepping motor according to an output of said carriage detecting means to set original positions of said carriage and said first stepping motor relative to each other;

reference position aligning means which operates after original position setting by said carriage original position setting means for controlling the driving of said first stepping motor and said second stepping motor so that said carriage moves from the original position of said carriage set by said carriage original position setting means to a predetermined position outside said first allowable range and said rotary means rotates said reference positions of said type-wheel and said rotary means into alignment with each other;

a stopper means installed in a second allowable range overlapping partly with said first allowable range for restraining rotation of said rotary means; and wheel original position setting means which operates after alignment of said reference positions by said reference position aligning means for controlling the driving of said first stepping motor and said second stepping motor so that said carriage moves from said predetermined position to a position where rotation of said rotary means is restrained by said stopper means and said second stepping motor is put in a step-out state to set original positions of said type-wheel and said second stepping motor.

2. A printing apparatus according to claim 1, wherein said rotary means includes a fixed plate attached fixedly to the output shaft of said second stepping motor and a protrusion formed on said fixed plate; and wherein said stopper means includes a stopper installed in said second allowable range, an operating member pivotally mounted on said carriage and including an integrally formed engaging part for engaging with said protrusion, and an arm for striking against said stopper.

3. A printing apparatus according to claim 1;

wherein said first allowable range has a length equivalent to a plurality of cycles of excitation phase of said first stepping motor, and said carriage original position setting means drives said first stepping motor by a redetermined number of steps after said carriage detecting means detects the passage of said carriage and thereby puts aid first stepping motor in a step-out state to set original positions of said carriage and said first stepping motor.

4. A printing apparatus according to claim 1;

wherein said connecting means includes a pin installed in said type-wheel and energized elastically toward said rotary means, said pin engaging with a notch formed on said rotary means when said reference positions of said type-wheel and said rotary means are aligned.

5. An initializing method of a printing apparatus with a type-wheel having a frame, a carriage movable within a movement range including a printable range, a first stepping motor for driving said carriage, rotary means rotatably mounted on said carriage for mounting said type-wheel rotatably, a second stepping motor for driving said rotary means, connecting means for operatively connecting said type-wheel with said rotary means when a reference position of said type-wheel aligns with a reference position of said rotary means, a stopper means installed in the vicinity of a side wall of said frame for restraining rotation of said rotary means, and carriage detecting means for detecting that said carriage has moved to a position within said movement range between said side wall and said printable range, said initializing method comprising in sequence:

a first step of setting original positions of said carriage and said first stepping motor relative to each other by controlling the driving of said first stepping motor according to an output of said carriage detecting means;

a second step of moving said carriage from said set original position to a predetermined position in the vicinity of said printable range;

a third step of aligning said reference positions of said type-wheel and said rotary means with each other by rotating said rotary means at said predetermined position;

a fourth step of moving said carriage from said predetermined position to said side wall and into engagement with said stopper means; and a fifth step of exciting said second stepping motor in predetermined phases in a step-out state to set original positions of said type-wheel and said second stepping motor.

6. An initializing method according to claim 5, wherein said first step includes:

moving said carriage toward said side wall until said carriage detecting means detects the passage of said carriage;

driving said first stepping motor by a predetermined number of steps to strike said carriage against said side wall; and exciting said first stepping motor in predetermined phases to set original position of said carriage and first stepping motor.

7. In a printing apparatus with a type-wheel having a frame, a carriage movable within a movement range including a printable range, a first stepping motor for driving said carriage, rotary means rotatable mounted on said carriage for mounting said type-wheel rotatably, a second stepping motor for driving said rotary means, and connecting means for operatively connecting said type-wheel with said rotary means when a reference position of said type-wheel aligns with a reference position of said rotary means, said printing apparatus comprising:

carriage detecting means for detecting that said carriage has moved toward a side wall of said frame;

carriage original position setting means for controlling the driving of said first stepping motor according to an output of said carriage detecting means to set original positions of said carriage and said first stepping motor relative to each other;

reference position aligning means which operates after original position setting by said carriage original position setting means for controlling the driving of said first stepping motor and said second stepping motor so that said carriage moves from the original position of said carriage set by said carriage original position setting means to a predetermined position remote from said side wall and said rotary means rotates to move said reference positions of said type-wheel and said rotary means into alignment with each other;

a stopper means installed in the vicinity of said side wall for restraining rotation of said rotary means, and wheel original position setting means, which operates after alignment of said reference positions by said reference position aligning means, for controlling the driving of said first stepping motor and said second stepping motor so that said carriage moves from said predetermined position to a position where rotation of said rotary means is restrained by said stopper means and said second stepping motor is put in a step-out state to set original positions of said type-wheel and said second stepping motor.

8. A printing apparatus according to claim 1; wherein said first stepping motor comprises four excitation phases and is driven by a two-phase excitation system.

9. A printing apparatus according to claim 1;

wherein said carriage detecting means is operated by an operating piece mounted on the lower part of said carriage attending on movement of said carriage.

* * * * *